US009114497B2

(12) United States Patent
Hildebrandt et al.

(10) Patent No.: US 9,114,497 B2
(45) Date of Patent: Aug. 25, 2015

(54) DEVICE FOR FINE-MACHINING A PERIPHERAL WORKPIECE SURFACE LOCATED ECCENTRICALLY IN RELATION TO A WORKPIECE AXIS OF A WORKPIECE

(71) Applicant: Supfina Grieshaber GmbH & Co. KG, Wolfach (DE)

(72) Inventors: Oliver Hildebrandt, Hornberg (DE); Christoph Weber, Biederbach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 453 days.

(21) Appl. No.: 13/737,585

(22) Filed: Jan. 9, 2013

(65) Prior Publication Data

US 2013/0189909 A1 Jul. 25, 2013

(30) Foreign Application Priority Data

Jan. 23, 2012 (EP) ..... 12152051

(51) Int. Cl.

| | |
|---|---|
| ***B24B 5/42*** | (2006.01) |
| ***B24B 21/16*** | (2006.01) |
| ***B24B 19/12*** | (2006.01) |
| ***B24B 33/04*** | (2006.01) |
| ***B24B 49/16*** | (2006.01) |
| ***B24B 5/00*** | (2006.01) |
| ***B24B 21/02*** | (2006.01) |
| ***B24B 41/00*** | (2006.01) |

(52) U.S. Cl.

CPC ... *B24B 5/00* (2013.01); *B24B 5/42* (2013.01); *B24B 19/12* (2013.01); *B24B 21/02* (2013.01); *B24B 41/007* (2013.01); *B24B 49/16* (2013.01)

(58) Field of Classification Search

CPC ..... B24B 49/16; B24B 47/206; B24B 33/04; B24B 5/42; B24B 19/12; B24B 19/125; B24B 21/00; B24B 21/16

USPC ..... 451/9, 10, 11, 12, 24, 49, 51, 251, 303, 451/307

See application file for complete search history.

(56) References Cited

U.S. PATENT DOCUMENTS

| | | | | |
|---|---|---|---|---|
| 1,715,550 | A * | 6/1929 | Heald et al. | 451/149 |
| 4,507,896 | A * | 4/1985 | Smith | 451/26 |
| 4,580,368 | A * | 4/1986 | Smith | 451/5 |

(Continued)

FOREIGN PATENT DOCUMENTS

| | | |
|---|---|---|
| DE | 30 08 606 A1 | 9/1981 |
| DE | 41 16 568 | 4/1992 |

(Continued)

OTHER PUBLICATIONS

European Search Report dated Jun. 12, 2012, and Translation thereof.

*Primary Examiner* — Eileen Morgan
(74) *Attorney, Agent, or Firm* — Henry M. Feiereisen LLC.

(57) ABSTRACT

A device for fine-machining a peripheral workpiece surface which is arranged eccentrically in relation to a workpiece axis of a workpiece, in particular of a pin bearing of a crankshaft, includes a rotary drive device for rotatably driving the workpiece about the workpiece axis, a pressing device for pressing a fine-machining tool against the peripheral workpiece surface, and a bearing device for supporting the pressing device on a frame. The device further includes a force application device which applies deceleration and/or acceleration forces on a bearing member of the bearing device, with the bearing member moving back and forth between two reversal positions when the workpiece rotates.

22 Claims, 16 Drawing Sheets

(56) References Cited

U.S. PATENT DOCUMENTS

| | | | | |
|---|---|---|---|---|
| 4,580,370 | A * | 4/1986 | Smith | 451/49 |
| 4,712,332 | A * | 12/1987 | Smith | 451/5 |
| 5,951,377 | A | 9/1999 | Vaughn et al. | |
| 2012/0043961 | A1 * | 2/2012 | Volk | 324/207.25 |

FOREIGN PATENT DOCUMENTS

| | | |
|---|---|---|
| DE | 102007059926 | 6/2009 |
| EP | 1 514 640 | 3/2005 |

* cited by examiner

DEVICE FOR FINE-MACHINING A PERIPHERAL WORKPIECE SURFACE LOCATED ECCENTRICALLY IN RELATION TO A WORKPIECE AXIS OF A WORKPIECE

CROSS-REFERENCES TO RELATED APPLICATIONS

This application claims the priority of European Patent Application, Serial No. EP 12 152 051.4, filed Jan. 23, 2012, pursuant to 35 U.S.C. 119(a)-(d), the content of which is incorporated herein by reference in its entirety as if fully set forth herein.

BACKGROUND OF THE INVENTION

The present invention relates to a device for fine-machining a peripheral workpiece surface that is located eccentrically in relation to a workpiece axis of a workpiece, in particular a pin bearing of a crankshaft.

It would be desirable and advantageous to address this problem and to provide a device, which allows fine-machining a workpiece that satisfies stringent quality requirements and which is at the same time more economical than prior-art devices.

SUMMARY OF THE INVENTION

According to one aspect of the present invention, a device for fine-machining a peripheral workpiece surface which is eccentrically arranged in relation to a workpiece axis of a workpiece includes a rotary drive device for rotatably driving the workpiece about the workpiece axis, a pressing device for pressing a fine-machining tool against the peripheral workpiece surface, a bearing device for supporting the pressing device on a frame and having a bearing member, and a force application device applying at least one of a deceleration force or an acceleration force on the bearing member, which moves back and forth between two reversal positions due to a rotation of the workpiece.

With the device according to the invention, the mass inertia forces generated during fine-machining a workpiece can be reduced or even substantially eliminated. In this way, the pressing forces acting in the contact region between the fine-machining tool and the workpiece can be made more uniform, so that the removal rates also become more uniform which can improve the machining quality. The deceleration forces can slow down the bearing member of the bearing device that moves back and forth, before reaching a reversal position. The acceleration forces can drive the bearing member towards the other reversal position when or after one reversal position has been reached. A significantly calmer operation of the bearing device is hereby attained. Due to this calmer operation, the rotary drive device, which rotationally drives the workpiece, need not generate drive torques commensurate with the back and forth motion of the bearing member in order to ensure a constant rotation of the workpiece. Instead, the rotary drive device needs only supply a substantially constant drive torque. As a result, the peripheral workpiece surface to be machined has a more precise roundness. In addition, the rotation speed of the rotary drive for the workpiece can be increased, thereby enhancing the machining quality, achieving higher material removal rates and reducing the time for fine-machining a workpiece.

According to an advantageous feature of the present invention, the force application device may exert in at least one of the reversal positions of the bearing member an acceleration force on the bearing member that is directed toward the other reversal position. This enables compensation of the mass inertia forces produced at the reversal position, in particular when a bearing member moves in the vertical direction in relation to the direction of gravity and when an acceleration force is applied preferably at least at the lower reversal position.

According to another advantageous feature of the present invention, the force application device may apply to the bearing member an acceleration force that is directed towards the respective other reversal position at least in the respective two reversal positions of the bearing member. This can compensate the mass inertia forces at both reversal positions.

According to another advantageous feature of the present invention, the force application device may apply deceleration and/or acceleration forces to the bearing member, when the bearing member is located at an intermediate position between the reversal positions. In this way, the bearing member can not only be decelerated and/or accelerated exactly at the reversal positions, but in addition or alternatively also at the intermediate positions, resulting in a particularly strong calming of the bearing device. In addition, the deceleration and/or acceleration forces can be introduced into the bearing member "more gently" (meaning more gradually as a function of time).

According to another advantageous feature of the invention, the force application device may include an energy store which can be charged during the movement of the bearing member from a first reversal position into a second reversal position and can be discharged in the opposite direction. Charging of the energy store can advantageously be accompanied by the application of deceleration forces on the bearing member. The discharge of the energy store may advantageously be accompanied by the application of acceleration forces to the bearing member and hence with a support of the movement of the bearing member from the first reversal position into the second reversal position. An energy store has the advantage that the kinetic energy of the bearing member can be used for generating the deceleration and/or acceleration forces, so that the rotary drive requires less energy for rotatably driving the tool. An "active" force application device, which includes an external energy supply and which would in principle be feasible and advantageous and which will be described below, can be omitted when using an energy store.

According to another advantageous feature of the present invention, at least two energy stores may be provided which may be charged in mutually opposing movement directions of the bearing member and which may therefore also be discharged in corresponding mutually opposing movement directions of the bearing member.

Advantageously, mechanical or pneumatic spring elements may be used as energy store. When such spring elements are charged, they generate deceleration forces for decelerating the bearing member. When the spring elements are discharged, the energy stored in the spring elements is released, causing acceleration of the bearing member.

According to another advantageous feature of the present invention, the force application device may include at least one cylinder/piston unit. Such unit is particularly suited for integration of the aforedescribed energy stores. However, a cylinder/piston unit may also be used as force transmitting device which discharges the mass inertia forces of the bearing member to the environment of the bearing member so as to compensate the mass inertia forces, for example by using energy stores, in particular in form of spring elements, or also by using active force generating elements, which can operate pneumatically, hydraulically, mechanically or electrically.

According to another advantageous feature of the present invention, the mass inertia forces may be particularly easily discharged into an environment of the bearing member when the interior space of a cylinder of a cylinder/piston unit is connected for fluid conduction with an additional volume.

Furthermore, a supply device may advantageously be provided for applying pressure to the interior space of a cylinder and/or an additional volume connected with the interior space with a presettable, in particular adjustable fluid pressure. Such supply device can be supplied, for example, with compressed air. The change of the fluid pressure can be used for adjusting a spring rate of the force application device and enables a simple adjustment of the magnitude of a deceleration and/or acceleration force.

The force application device may be constructed so as to provide a presettable maximum force for a specific rotation speed of the workpiece and a specific distance between the peripheral workpiece surface and the workpiece axis of the workpiece and for a specific mass of the bearing member and of the pressing device and, if necessary, of the fine-machining tool. For easily adapting the device, in particular for different rotation speeds and different distances between the peripheral workpiece surface and the workpiece axis of the workpiece, a control device for controlling the magnitude and/or the direction and/or the time dependence of a deceleration and/or acceleration force operating on the bearing member may advantageously be provided. The device can thus be quickly and easily adapted to different workpiece geometries and machining parameters.

According to another advantageous feature of the present invention, a device for measuring the position of the bearing member may be provided. The force application device can then be particularly easily controlled in conjunction with the aforedescribed control device.

Advantageously, the bearing member may be guided in a linear guide to ensure a defined movement of the bearing member.

The linear guide may advantageously be pivotally supported relative to the frame, for example, with a swivel member. In this way, the bearing member can follow the movements of the peripheral workpiece surface to be machined in a direction transverse to its back and forth motion.

Alternatively, the linear guide may advantageously be arranged on a carriage which is movably supported on the frame in a direction transverse, in particular perpendicular, to the guide axis of the linear guide. Such structure can also be referred to as "cross slide".

According to another advantageous feature of the present invention, an additional force application device may be provided for compensating mass-induced inertia forces which are generated due to a movement of the bearing member about a swivel axis or due to the movement of the bearing member in a direction transverse to the guide axis of the linear guide. (Such force application device can also be used in absence of a force application device for generating deceleration and/or acceleration forces on the bearing member that moves back and forth between two reversal positions.)

The aforedescribed device is suitable for bearing members which move back and forth in a substantially horizontal direction. The aforedescribed device can also be used for bearing members which move back and forth in a vertical direction.

When the bearing member is movable along a vertical axis in relation to the direction of the gravitational force between the reversal positions, a compensation device may advantageously be provided which generates at least proportionately a vertically upwardly directed holding force of a magnitude that corresponds to the weight of the pressing device, to the weight of the bearing member and to the weight of the fine-machining tool (for example a finishing stone or a finishing belt guided on a belt guide). In this way, at least a portion of the weight of the aforementioned parts of the device can be compensated.

Alternatively or in addition, the holding force may be generated at least proportionately by the force application device. At least a portion of the weight of the aforementioned parts of the device can then be compensated. When the force application device generates at least a portion of the holding force, the force application device may advantageously apply an adjustable holding force to the bearing member. When a spring is used for producing at least a portion of the holding force, such adjustment can be made by changing the spring bias (for a mechanical spring by changing the position of spring stops; for a pneumatic spring by changing the gas pressure).

When the force application device enables adjustment of a holding force, the same force application devices may be used for both horizontally movable bearing members and for vertically movable bearing members that are simultaneously weight-compensated. This advantageously makes use of the benefits of a modular system.

Within the context of the invention, the fine-machining tool may be a polishing tool, a lapping tool, a grinding tool or a burnishing tool.

In particular, the fine-machining tool may be a finishing tool, which cooperates with a pressing device and has a wearing, abrasive effective surface. For example, the finishing tool may be in form of a finishing stone which is mounted on the pressing device. The finishing tool may also be a finishing belt which is preferably pressed against the peripheral workpiece surface by a pressing shell of the pressing device.

In particular when the fine-machining tool is a finishing tool, the device advantageously includes an oscillatory drive for imparting an oscillatory motion on the workpiece which is parallel to the workpiece axis, so that a crosshatch finish characteristic for the finishing process can be produced with the device.

BRIEF DESCRIPTION OF THE DRAWING

Other features and advantages of the present invention will be more readily apparent upon reading the following description of currently preferred exemplified embodiments of the invention with reference to the accompanying drawing, which shows in.

DETAILED DESCRIPTION OF PREFERRED EMBODIMENTS

Figure 1:
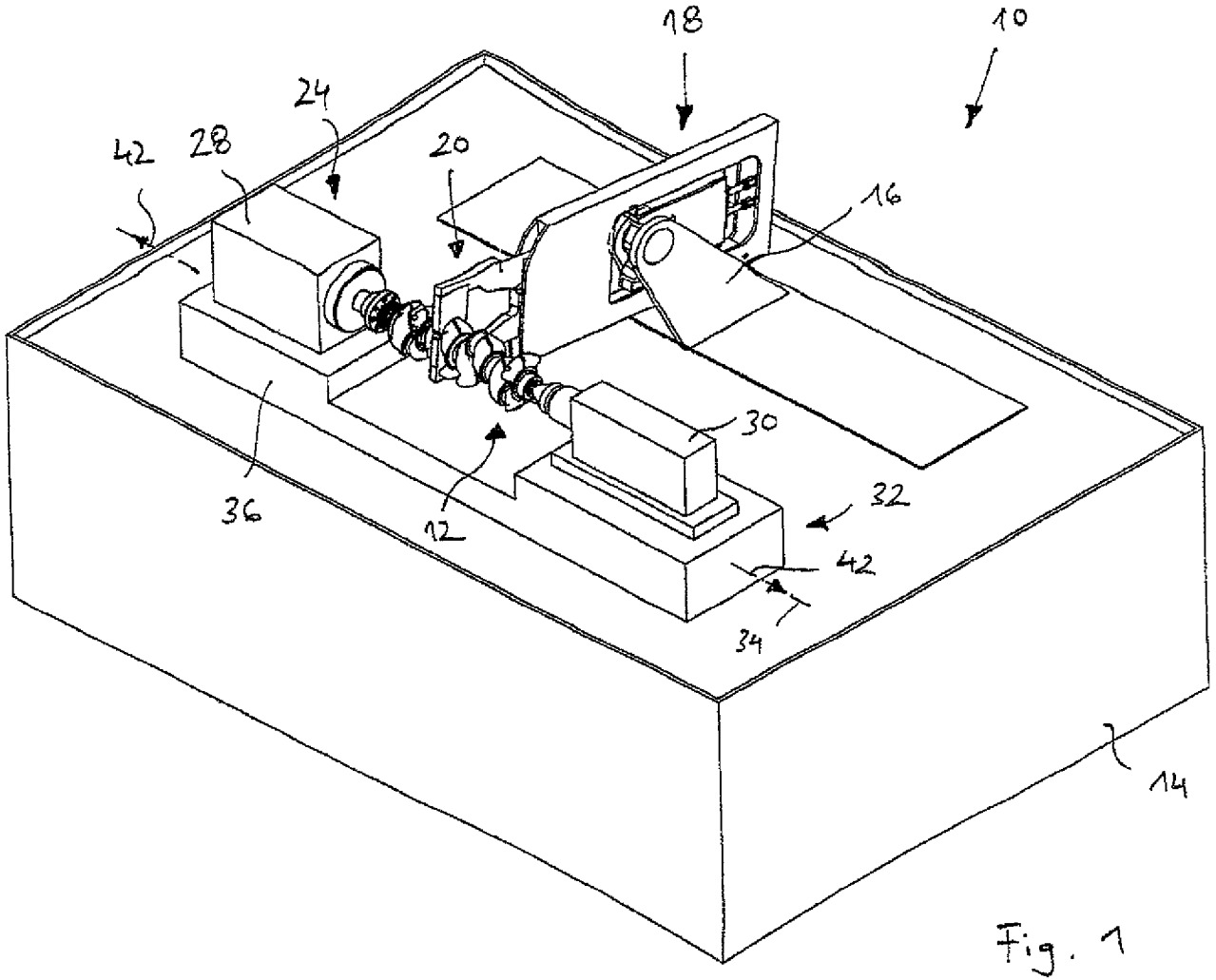
FIG. 1 a perspective view of an embodiment according to the present invention of a device for finishing fine-machining a workpiece.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an embodiment of the device having the overall reference symbol 10 which can be used for fine-machining, in particular finish-machining, of a workpiece 12. The device 10 includes a stationary frame 14 with a frame member 16 for connecting a bearing device 18 to the frame 14, as will be described below. The bearing device 18 is provided for supporting a pressing device 20 on the frame 14, as will also be described below. The pressing device 20 presses a fine-machining tool in form of a finishing tool 22 (see FIG. 2), for example in form of a finishing belt, against a surface of the workpiece 12 to be finish-machined. The finishing belt is guided on a finishing belt guide 23, for example in form of a return pulley 25.

Figure 2:
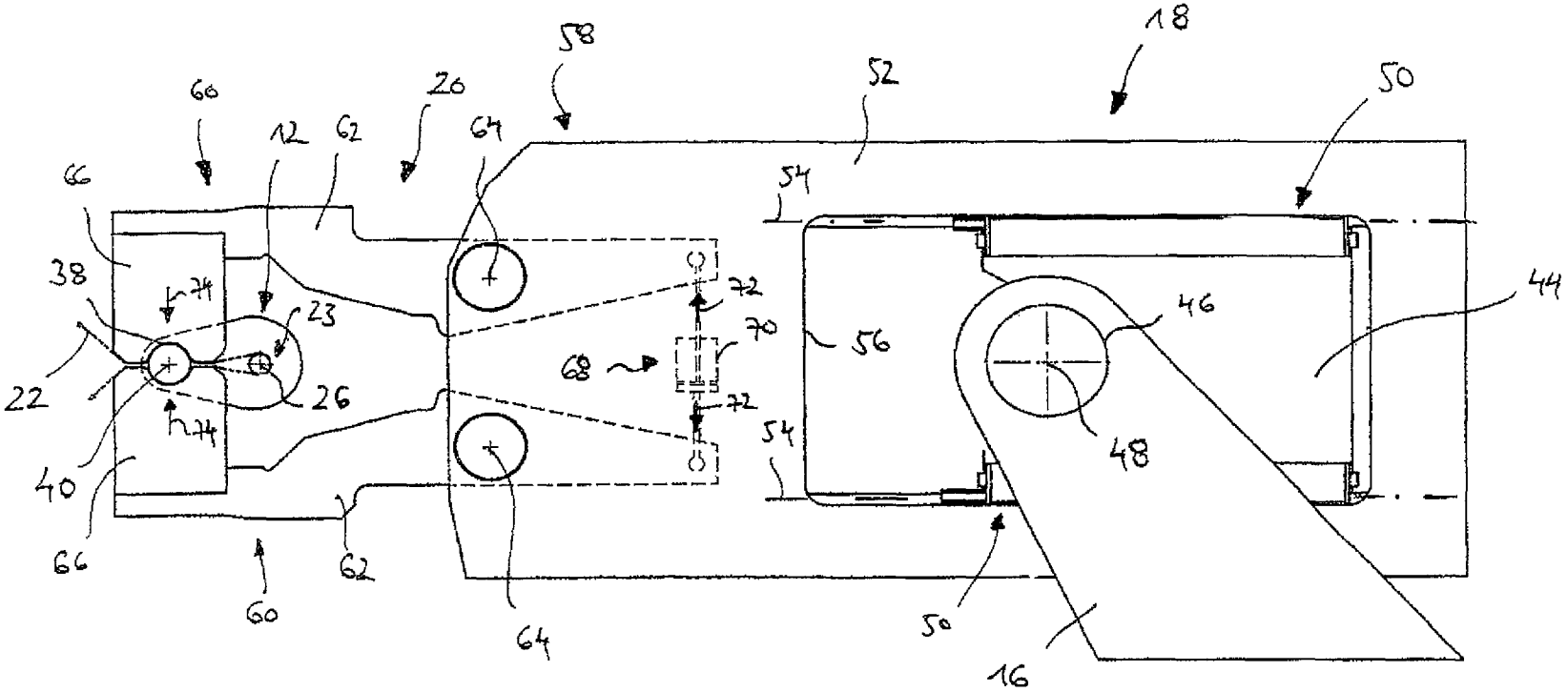
FIG. 2 a side view of a detail of the device according to FIG. 1, with a fine-machining tool in form of a finishing tool, a pressing device and a bearing device.

The device 10 includes a rotary drive device 24 (see FIG. 1) for rotating the workpiece 12 about a workpiece axis 26 (see FIG. 2). The rotary drive device 24 includes a headstock 28 and a tailstock 30. The workpiece 12 is clamped between the headstock 28 and the tailstock 30. The assembly composed of the rotary drive device 24 and the workpiece can be moved back and forth with a short stroke by way of an oscillatory drive 32 along an oscillation axis 34 that is parallel to the workpiece axis 26.

Advantageously, the oscillatory drive 32 includes a carrier 36 for mounting the headstock 28 and the tailstock 30. The carrier 36 is driven by a conventional driving device, for example an eccentric drive, which will not be described in detail.

The workpiece 12 has a peripheral workpiece surface 38 which is eccentrically offset in relation to the workpiece axis 26. More particularly, the peripheral workpiece surface 38 extends concentrically about an auxiliary axis 40, which extends parallel to and is spaced from the workpiece axis 26.

More particularly, the workpiece 12 is a crankshaft. The peripheral workpiece surface 38 is in particular the bearing surface of a pin bearing of the crankshaft.

When the workpiece 12 is machined, the workpiece 12 rotates about the workpiece axis 26. The peripheral workpiece surface 38 moves commensurate with the spacing between the axes 40 and 26 in a circular orbit about the workpiece axis 26. An oscillatory movement indicated in FIG. 1 with a double arrow 42 is superimposed by the oscillatory drive 32 on the aforedescribed rotary movement so as to apply by way of the abrasive effect of the finishing tool 22 a cross-hatched finish to the peripheral workpiece surface 38.

Because the peripheral workpiece surface 38 moves, as described above, about the workpiece axis 26 in a circular pattern, the finishing tool 22 and hence the pressing device 20 must also be able to follow this movement of the peripheral workpiece surface 38. Therefore, the support device 18 for supporting the pressing device 20 on the frame 14 has two degrees of freedom, thereby allowing the pressing device 20 to move in a plane perpendicular to the workpiece axis 26.

The support device 18 includes a swivel member 44 which is held on the frame member 16 by a swivel bearing 46 for pivoting about a swivel axis 48. The swivel axis 48 extends parallel to the workpiece axis 26.

The swivel member 44 is used for mounting at least one linear guide 50, with which a bearing member 52 is supported for movement relative to the swivel member 44 along a guide axis 54 of the linear guide 50.

The bearing member 52 extends substantially within a plane extending perpendicular to the workpiece axis 26. The bearing member 52 includes an opening 56 through which the swivel bearing 46 passes.

The bearing member 52 has a bearing member end 58 facing the workpiece 26 for arranging the pressing device 20.

The pressing device 20 includes at least one pressing element 60, preferably two pressing elements 60, which are constructed, for example, in form of cutter jaws 62. The cutter jaws 62 can be pivoted relative to the bearing member 52 about pressing swivel axes 64. The pressing swivel axes 64 extend parallel to the swivel axis 48 of the swivel member 44.

The cutter jaws 62 have at their end facing the workpiece 12 pressing segments 66 which are constructed in particular in form of a shell, so that a finishing tool 22 constructed as a finishing belt can be pressed against the peripheral workpiece surface 38 along a partial periphery of the peripheral workpiece surface 38.

For generating a pressing force, the pressing device 20 includes a pressing drive 68 which applies a pressing force on the pressing elements 60. The pressing drive 68 is constructed, for example, as a hydraulic unit 70 which applies pressing forces 72 to the pressing elements 60.

For example, the pressing drive 68 and the pressing segments 66 are arranged in relation to the pressing pivot axes 64 on opposing sides of the pressing elements 60. In this way, opposing pressing forces 72 can be converted into aligned pressing forces 74.

The device 10 includes a force application device 76 (see FIG. 3) operating between the swivel member 44 and the bearing member 52. The force application device 76 generates deceleration and acceleration forces which operate on the bearing member 52 and are oriented parallel to the guide axes 54 of the linear guides 50.

The force application device 76 includes at least one cylinder/piston unit 78, for example two cylinder/piston units 78 arranged in parallel. The units 78 include each a piston 80 which is immovably connected with the bearing member 52 by way of a corresponding piston rod 82.

The piston 80 is slideably supported in cylinders 84 which are fixedly connected with the swivel member 44. The pistons 80 divide the cylinders 84 into separate interior spaces, namely a first interior space 86 and a second interior space 88.

The interior spaces 86, 88 are each connected with a corresponding pressurized gas and form energy stores 90 that can be charged and discharged in opposite directions.

Figure 3:
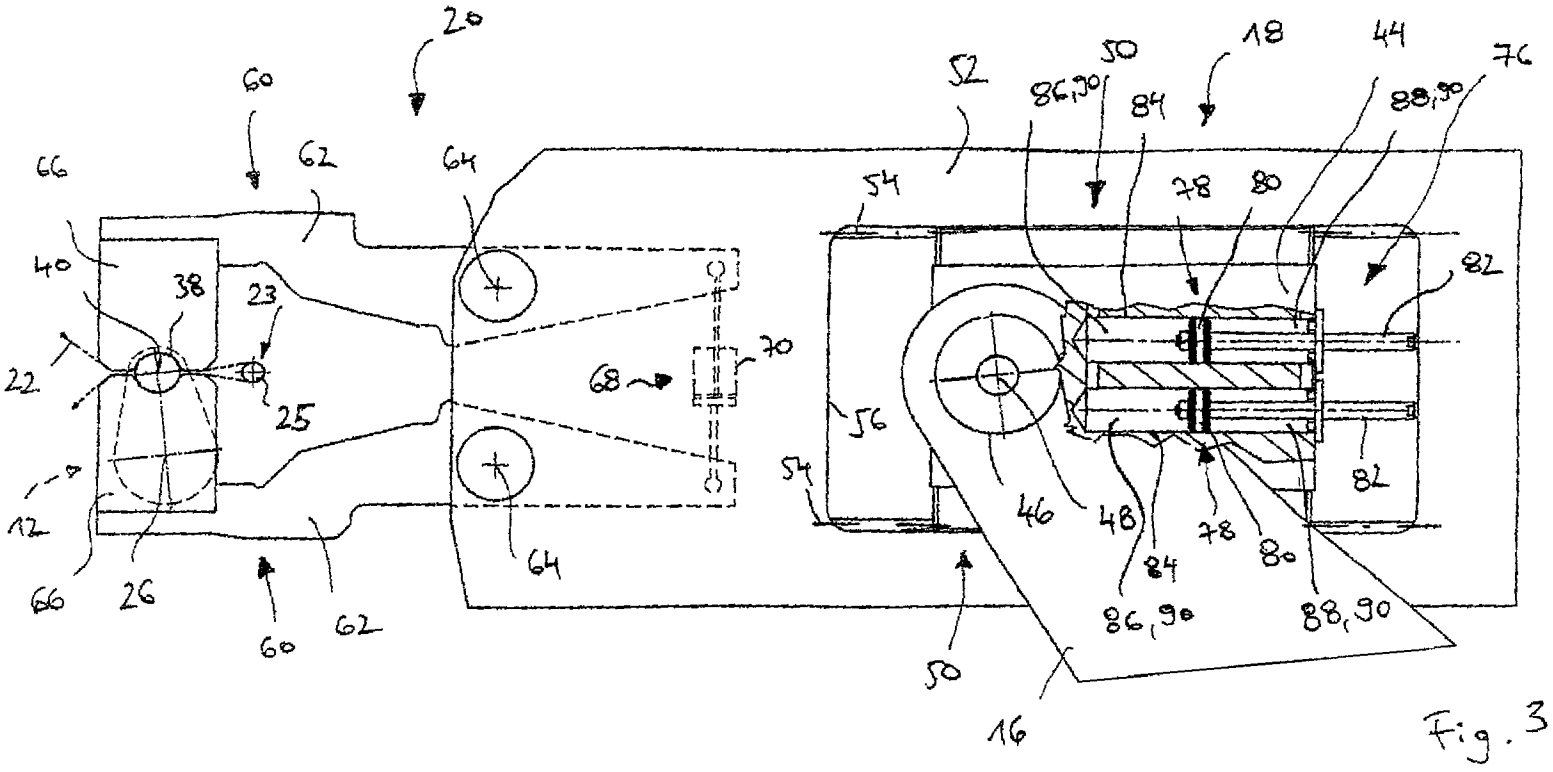
FIG. 3 a side view corresponding to FIG. 2 in a partial cross-sectional view in the region of a force application device with an initial position of a peripheral workpiece surface of a workpiece corresponding to 0°.

FIG. 3 shows the workpiece 12 in an initial position, in which the peripheral workpiece surface 38 is in a "12 o'clock position" in relation to the workpiece axis 26. This initial position of the workpiece 12 will hereinafter be referred to as "0°". By rotating the workpiece 12 with the rotary drive device 24 about the workpiece axis 26, for example, clockwise, the workpiece 12 is rotated starting from the position illustrated in FIG. 3, for example in a position that is rotated relative to the initial position by 90° (see FIG. 4).

As a result of the positive-locking fit between the pressing segments 66 and the peripheral workpiece surface 38, the pressing device 20 moves upward in the vertical direction during the rotation of the workpiece 12 and simultaneously in the horizontal direction away from the workpiece axis 26. The horizontal movement of the pressing device 20 causes a corresponding horizontal displacement of the bearing member 52 relative to the swivel member 44. The vertical movement of the pressing device 20 causes the bearing member 52 and the swivel member 44 to pivot about the swivel axis 48.

Due to the horizontal displacement of the bearing member 52, the position of the piston 80 changes relative to the cylinders 84. In particular, the gas in the second interior spaces 88 is compressed, so that increasingly greater deceleration forces operate on the bearing member 52 when the bearing member 52 moves from the initial position (FIG. 3) into the intermediate position illustrated in FIG. 4. These deceleration forces are maximal in the fully compressed position of the second interior spaces 88 illustrated in FIG. 4. Starting from this position, an additional rotation of the workpiece 12 about the workpiece axis 26 causes enlargement of the second interior spaces 88, until the interior spaces 86 and 88 have again the same size at an intermediate position ("180°") illustrated in FIG. 5. During the movement from the intermediate position "90°" to the intermediate position "180°", the energy stores 90 in form of the second interior spaces 88 are discharged, so that acceleration forces oriented toward the workpiece 12 are applied to the bearing member 52.

Figure 4:
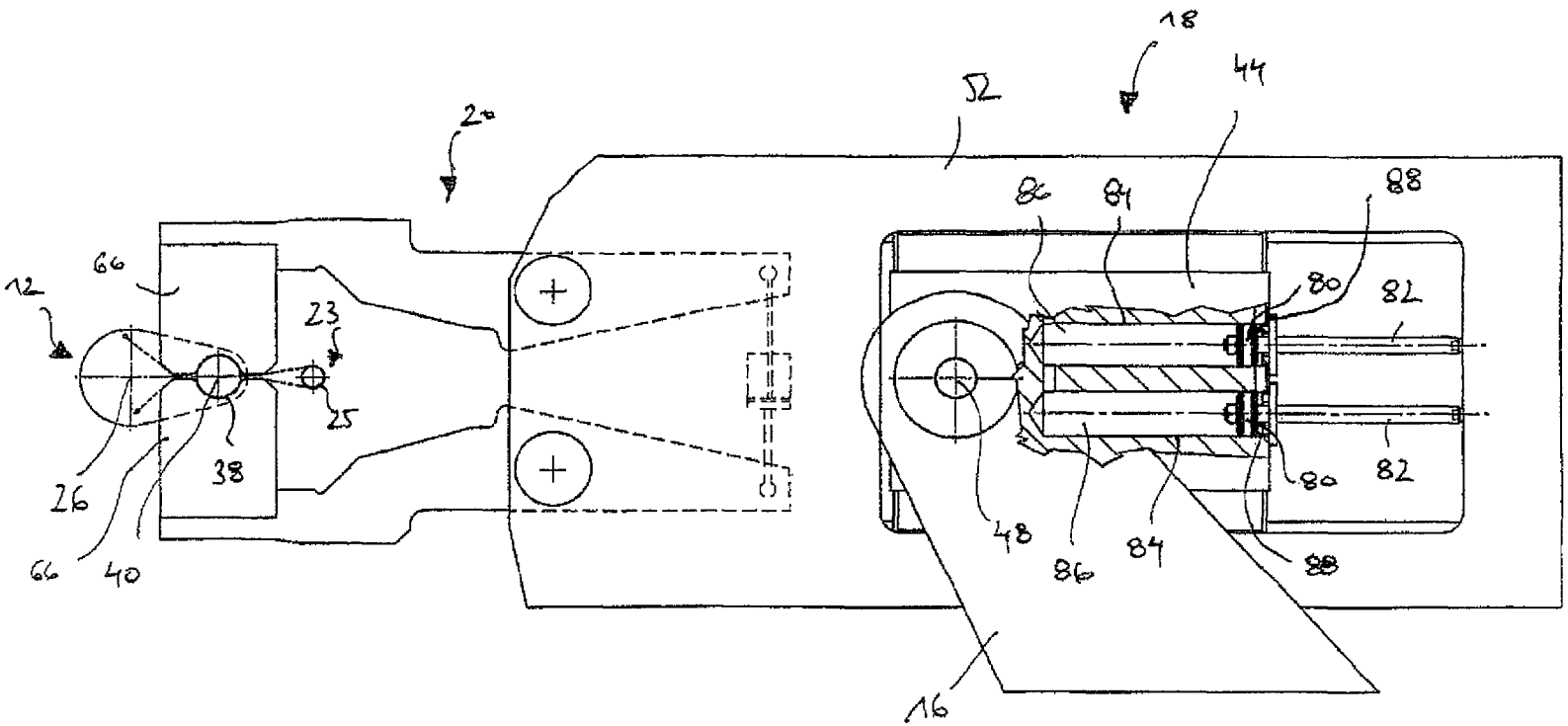
FIG. 4 a side view corresponding to FIG. 3 in a position of the workpiece rotated by 90° relative to the initial position.
Figure 5:
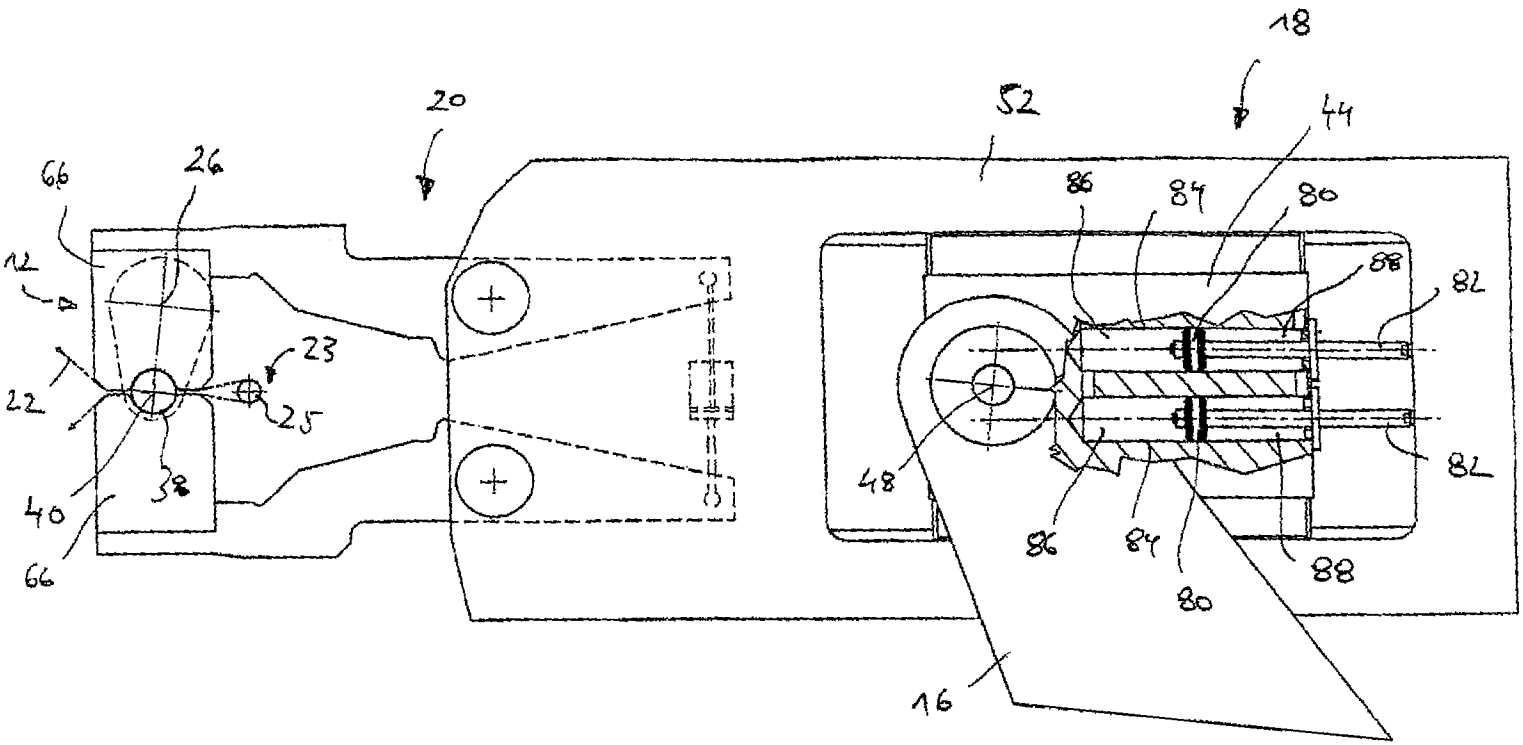
FIG. 5 a side view corresponding to FIG. 3 in a position of the workpiece rotated by 180° relative to the initial position.
Figure 6:
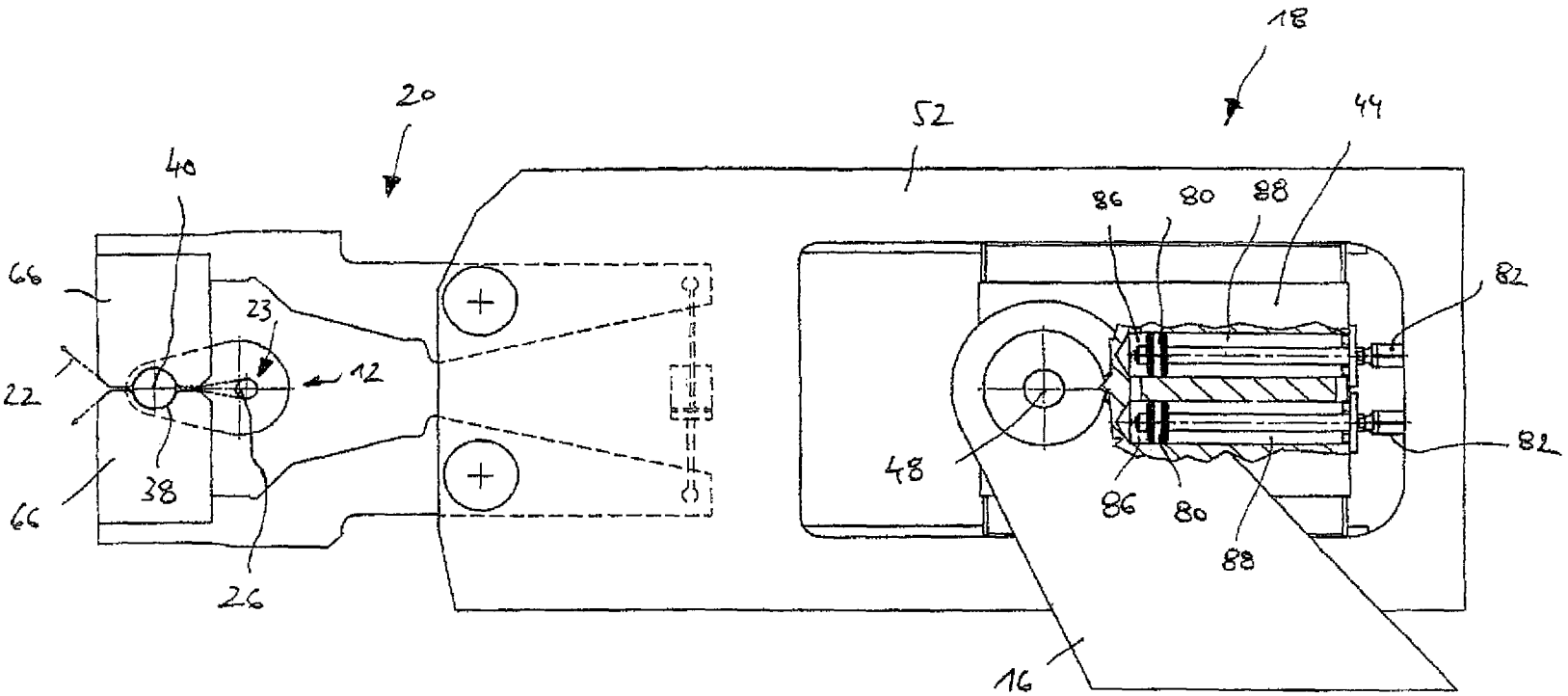
FIG. 6 a side view corresponding to FIG. 3 in a position of the workpiece rotated by 270° relative to the initial position.

FIG. 5 shows an intermediate position of the bearing member 52. FIG. 4 shows a first reversal position of the bearing member 52; FIG. 6 shows a second reversal position of the bearing member 52.

Starting from the intermediate position illustrated in FIG. 5, the bearing member 52 moves from the position "180°" into the position "270°" (see FIG. 6) during movement of the workpiece 12. This movement of the bearing member 52 is accompanied by a compression of the first interior spaces 86, which exert increasingly stronger deceleration forces on the bearing member 52. The accompanying charging of the first interior spaces 86 is used to apply acceleration forces on the bearing member 52 when the workpiece transitions from the position "270°" back to the initial position "0°" (i.e., when the workpiece 12 moves from the rotation position illustrated in FIG. 6 into the rotation position illustrated in FIG. 3) by way of discharging the energy stores 90 in form of the first interior spaces 86.

Figure 7:
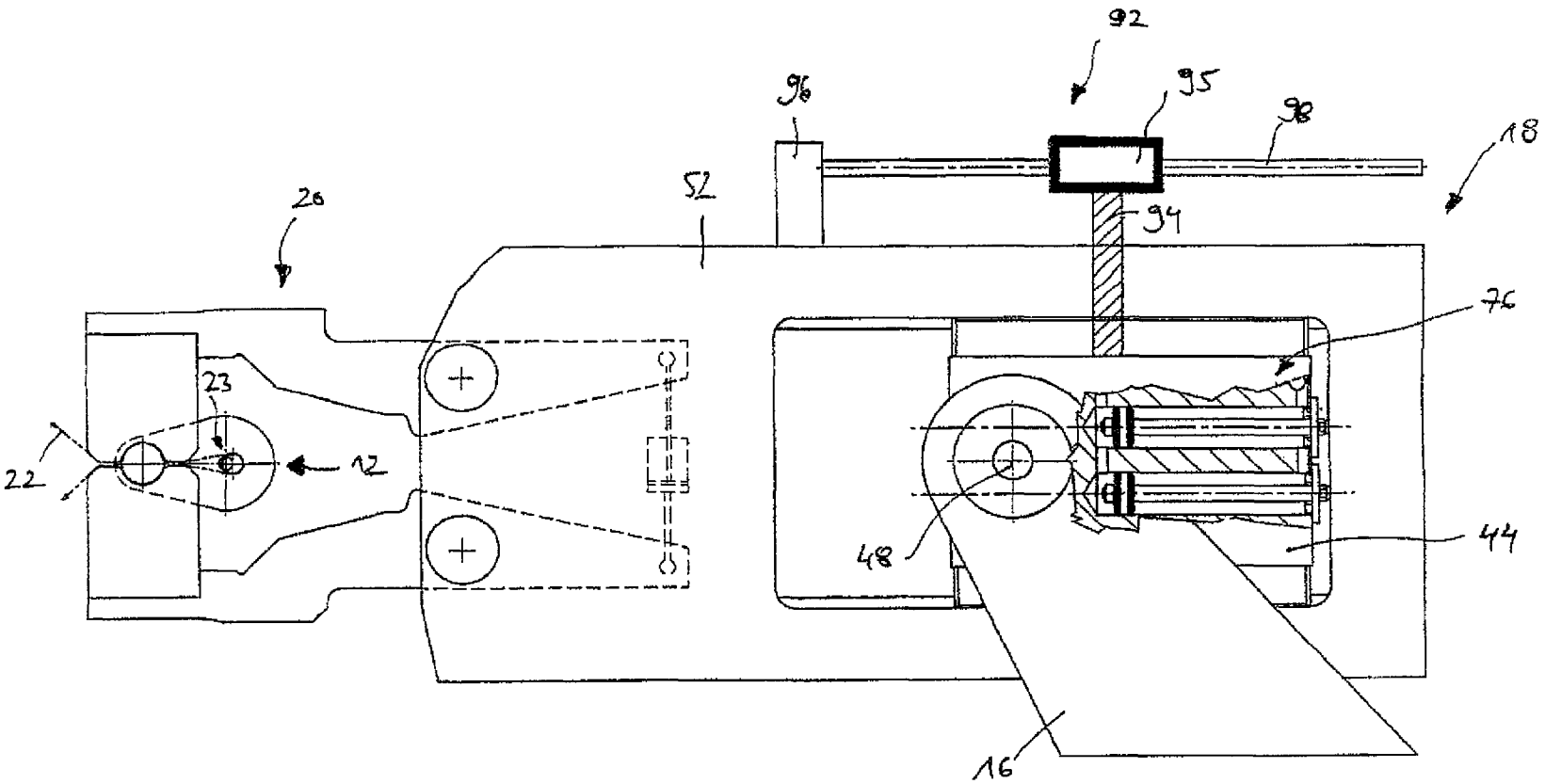
FIG. 7 a side view corresponding to FIG. 3 of a device which is augmented with a device for measuring the position of a bearing member of the bearing device.

In a modified embodiment of the device 10, a device 92 for measuring the position of the bearing member 52 relative to the swivel member 44 is provided (see FIG. 7). The device 92 includes a first holding segment 94 connected with the swivel member 44 for holding a distance sensor 95. The device furthermore includes a second holding segment 96 connected with the bearing member 52 for holding a measurement segment 98. The distance sensor 95 is used to measure a movement of the measurement segment 98 and thus to measure the position of the bearing member 52 relative to the swivel member 44. This position measurement is advantageous for controlling the force application devices 76, as will be described below.

Figure 8:
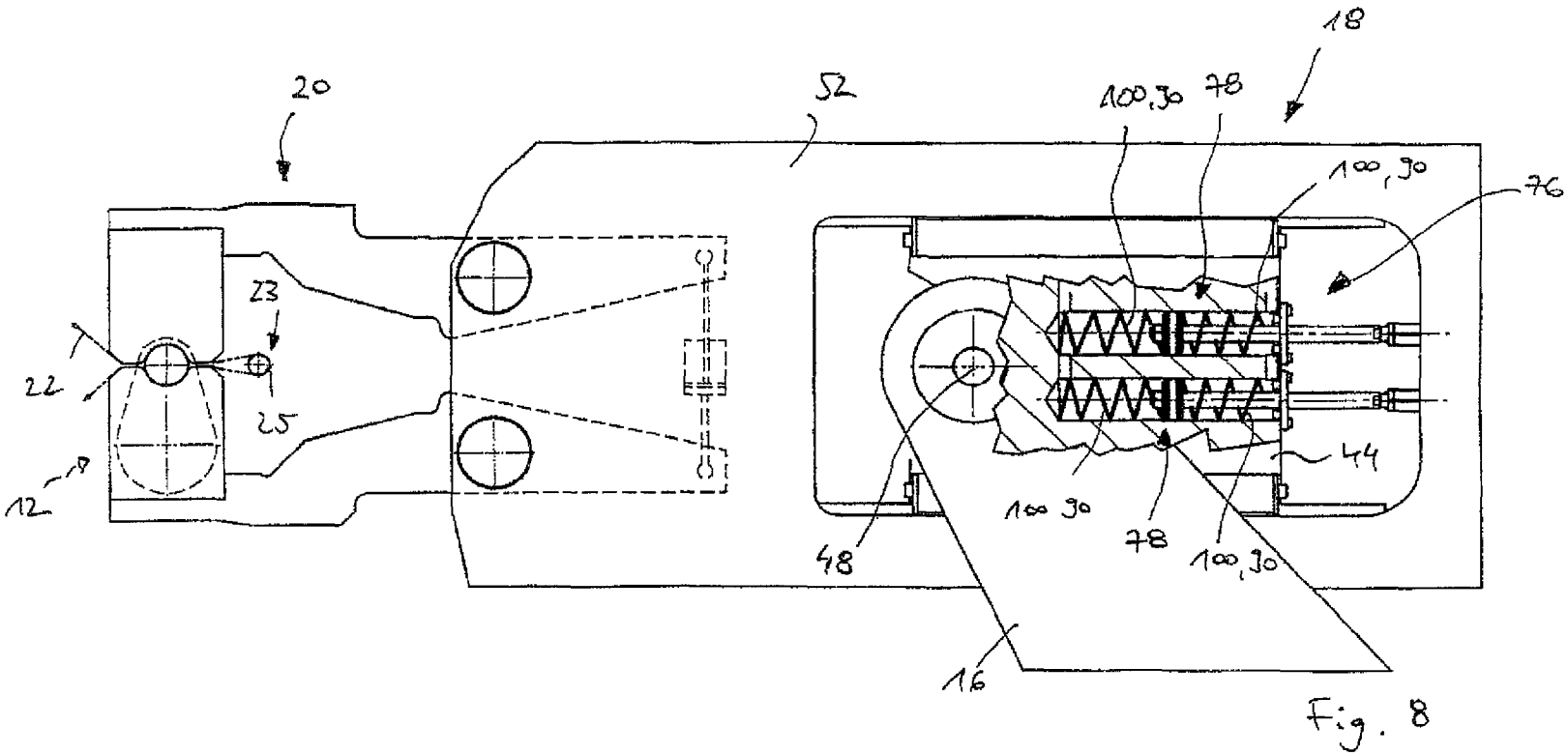
FIG. 8 a side view corresponding to FIG. 3 when using mechanical springs as force-generating elements an energy store.

An embodiment illustrated in FIG. 8 also includes a force application device 76 with cylinder/piston units 78. In this embodiment, the energy stores are constructed as mechanical spring elements 100. The operation of this particularly simple construction of the force application device 76 according to FIG. 8 corresponds to the operation of the force application device 76 described above with reference to FIGS. 3 to 6.

Figure 9:
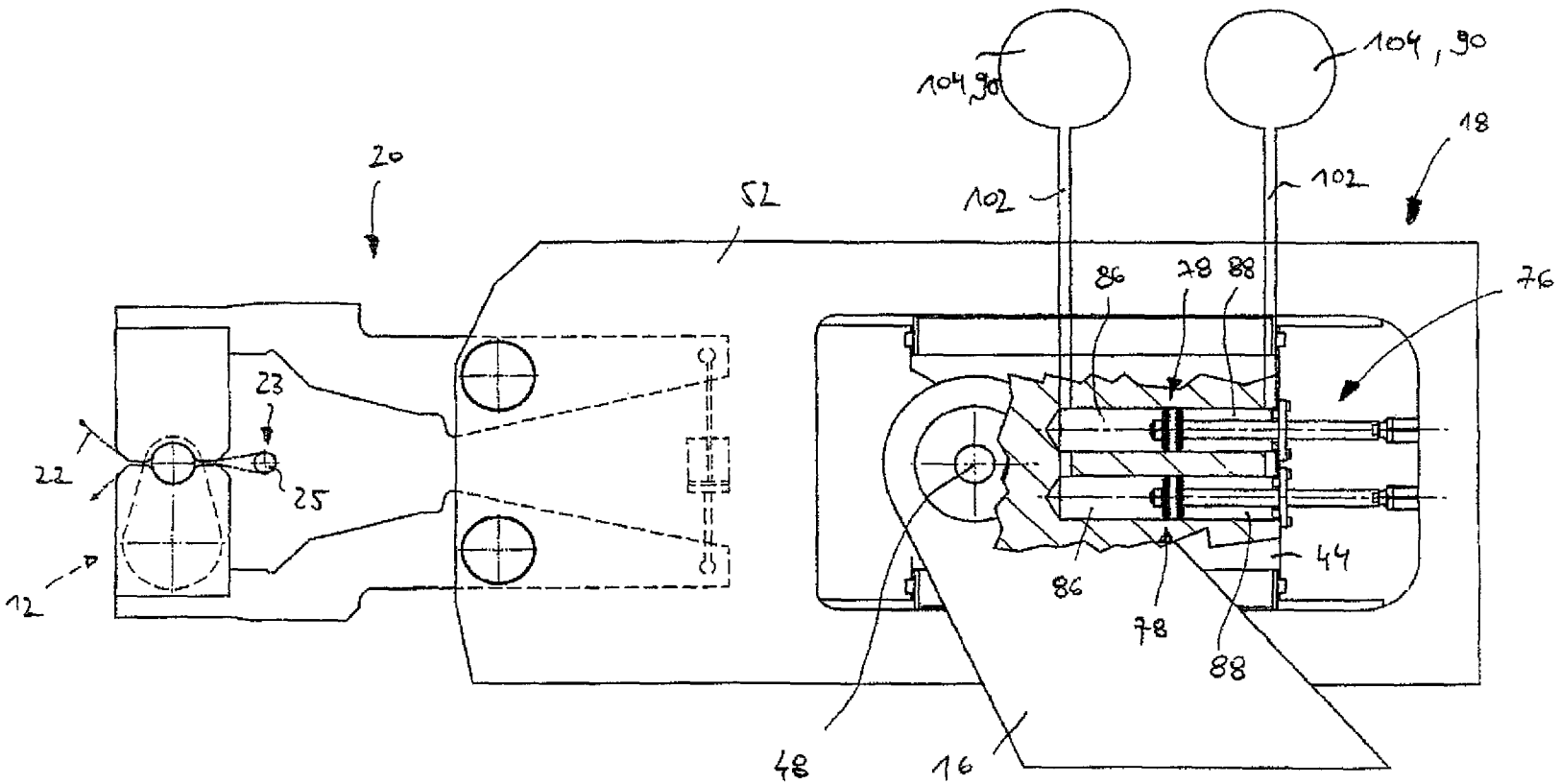
FIG. 9 a side view corresponding to FIG. 3 when using additional volumes in fluid connection with cylinder/piston units.

An embodiment illustrated in FIG. 9 likewise includes a force application device 76 with cylinder/piston units 78. The first interior spaces 86 and the second interior spaces 88 of the units 78 are each connected with additional volumes 104 by way of lines 102. The additional volumes 104 are intended to receive a pressurized fluid, in particular a gas, which operates as energy store 90. A spring rate of the force application device can be adjusted by adjusting the pressure of the gas in the additional volumes 104 and/or by adjusting the size of the additional volumes for a fixed predetermined quantity of gas, wherein higher pressures result in a steeper characteristic spring curve. The fundamental operation of the force application device 76 according to FIG. 9 corresponds to the operation of the force application device 76 described above with reference to FIGS. 3 to 6.

Figure 10:
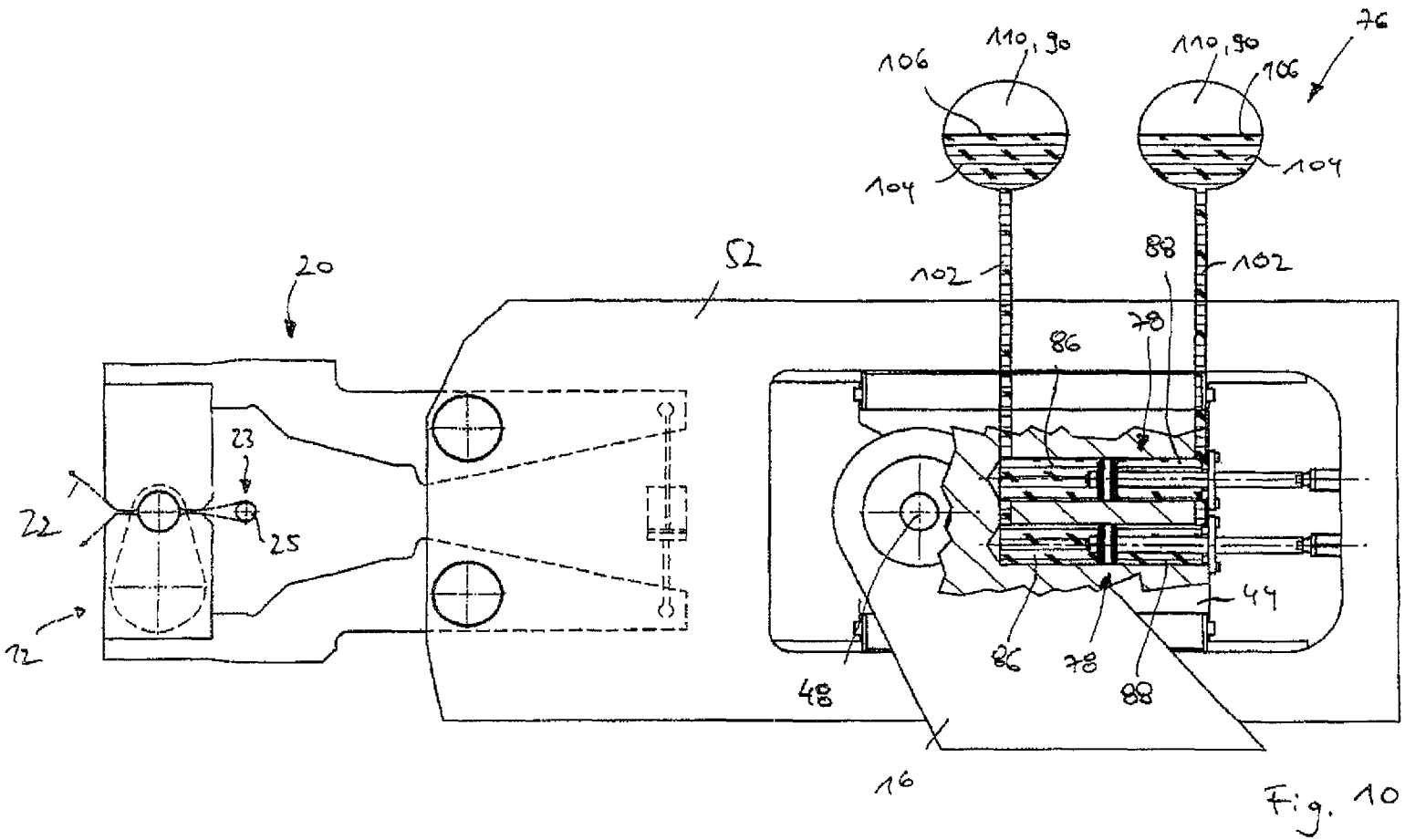
FIG. 10 a side view corresponding to FIG. 3 when using a hydraulically controlled gas spring.
Figure 11:
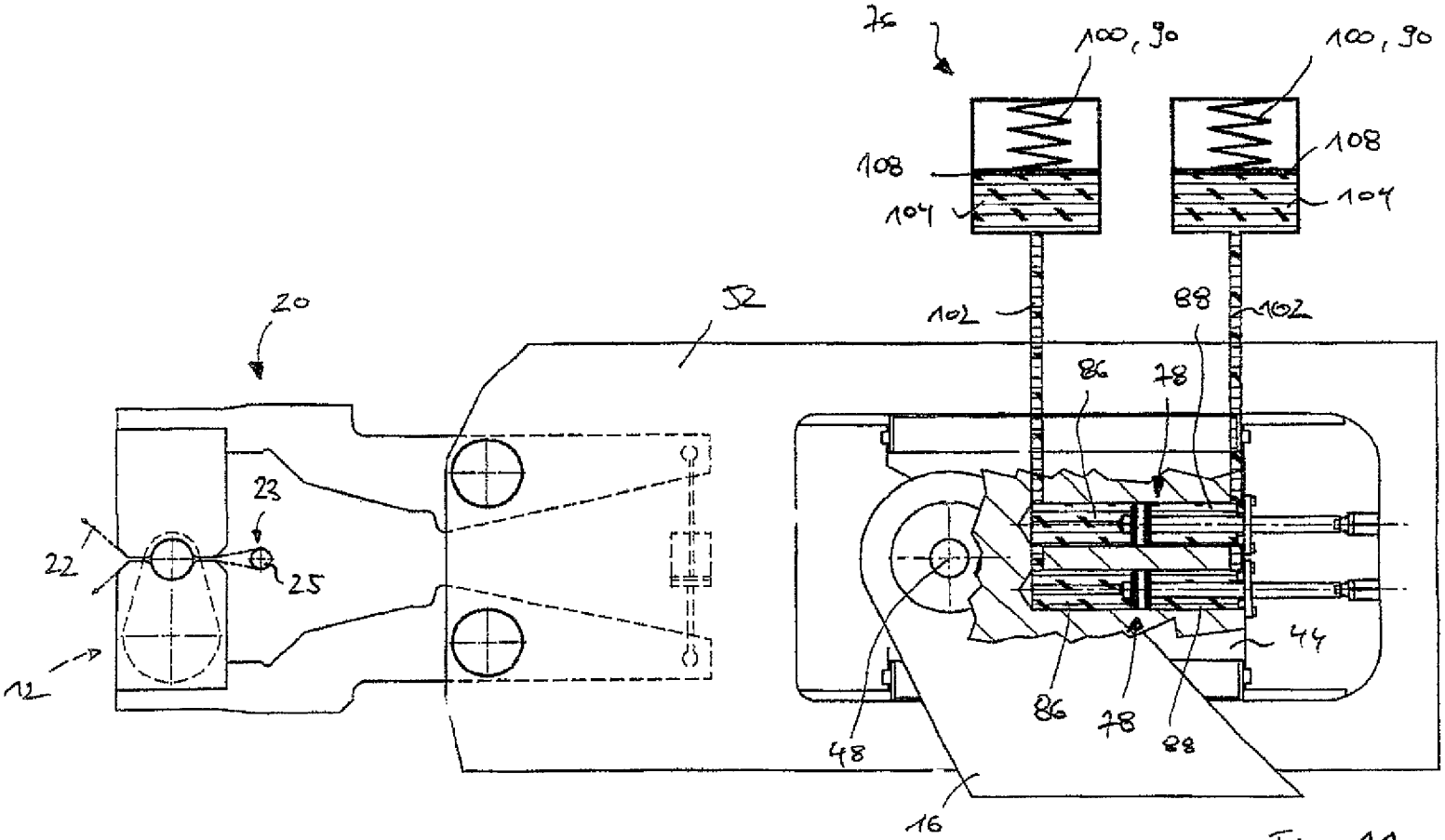
FIG. 11 a side view corresponding to FIG. 3 when using a hydraulically controlled mechanical spring.

The embodiments illustrated in FIGS. 10 and 11 also include cylinder/piston units 78, whose interior spaces 86, 88 are each connected with additional volumes 104 by way of lines 102.

The interior spaces 86, 88, the lines 102 and the additional volumes are preferably filled with a fluid. With this arrangement, the fluid can advantageously be used to transmit a force to a region outside the bearing member 52. Accordingly, particularly compact cylinder/piston unit 78 can be employed.

The additional volumes 104 are closed off by way of a closure element 106 in form of a membrane (FIG. 10) or in form of a piston 108 (FIG. 11). The closure elements 106, 108 are associated with energy stores 90 in form of pneumatically operating springs 110 (FIG. 10) and/or mechanically operating springs 100 (FIG. 11).

When the bearing member 52 of the embodiments according to FIG. 10 or FIG. 11 moves, the additional volumes 104 are each alternatingly filled more or the spring elements 100, 110 are each alternatingly compressed, so that these are alternatingly charged and discharged as energy stores 90. In all other aspects, the operation of the force application device 76 according to FIGS. 10 and 11 corresponds to the operation of the force application device 76 described above with reference to FIGS. 3 to 6.

Figure 12:
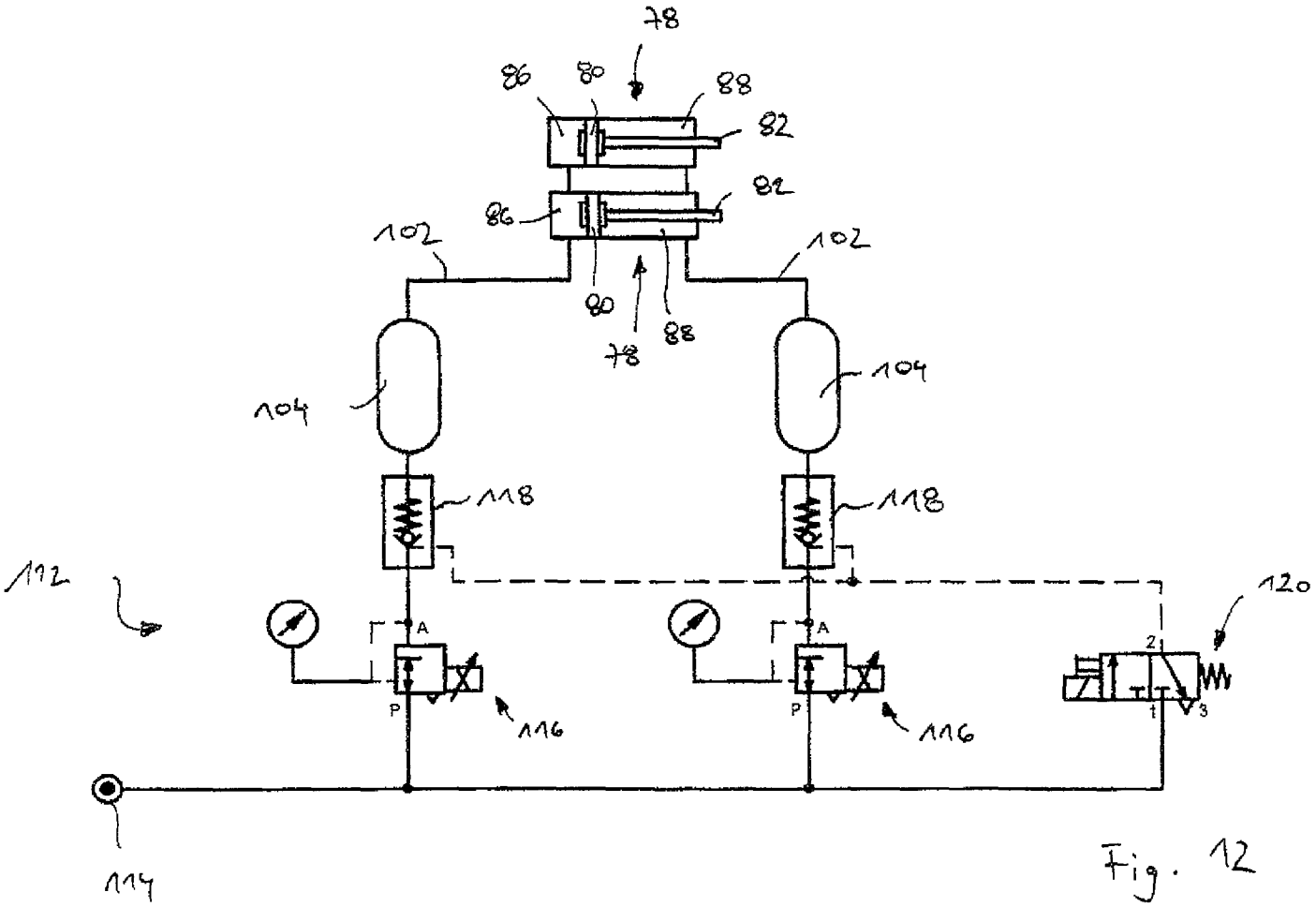
FIG. 12 a schematic diagram of an embodiment of a supply device for applying pressure to interior spaces of a cylinder and/or to additional volumes connected with the interior spaces with a pre-settable, in particular changeable fluid pressure.

FIG. 12 illustrates a supply device 112 for supplying the interior spaces 86, 88 of the units 78 and of optional additional volumes 104 with a pressurized fluid. The supply device 112 includes a pressure source 114 (for example a compressed air supply), which is in communication with the interior spaces 86, 88 and the optional additional volumes 104 via proportional valves 116 and check valves 118.

The proportional valves 116 are controlled, for example, with electromagnets. It is sufficient to control opening of the proportional valves 116 for increasing the pressure in the respective interior spaces 86, 88. When the pressure in the interior spaces 86, 88 is to be reduced, an additional valve 120 is operated which applies a control pressure to the check valves 118, so that the pressure in the interior spaces 86, 88 and optionally in the additional volumes 104 can be reduced.

Figure 13:
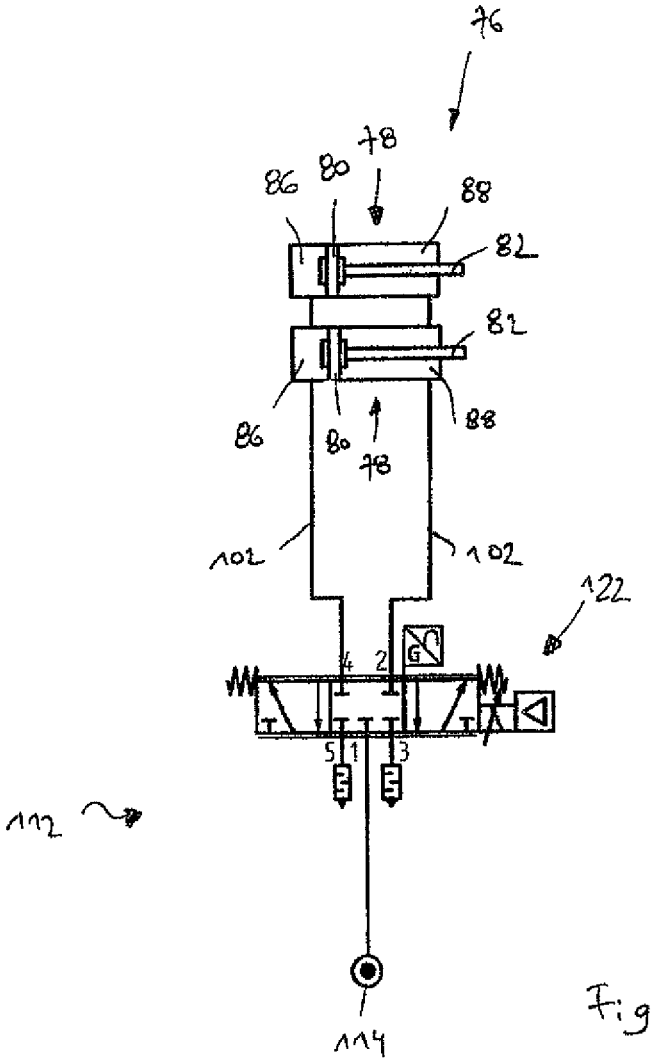
FIG. 13 a schematic view of an additional embodiment of a supply device.
Figure 14:
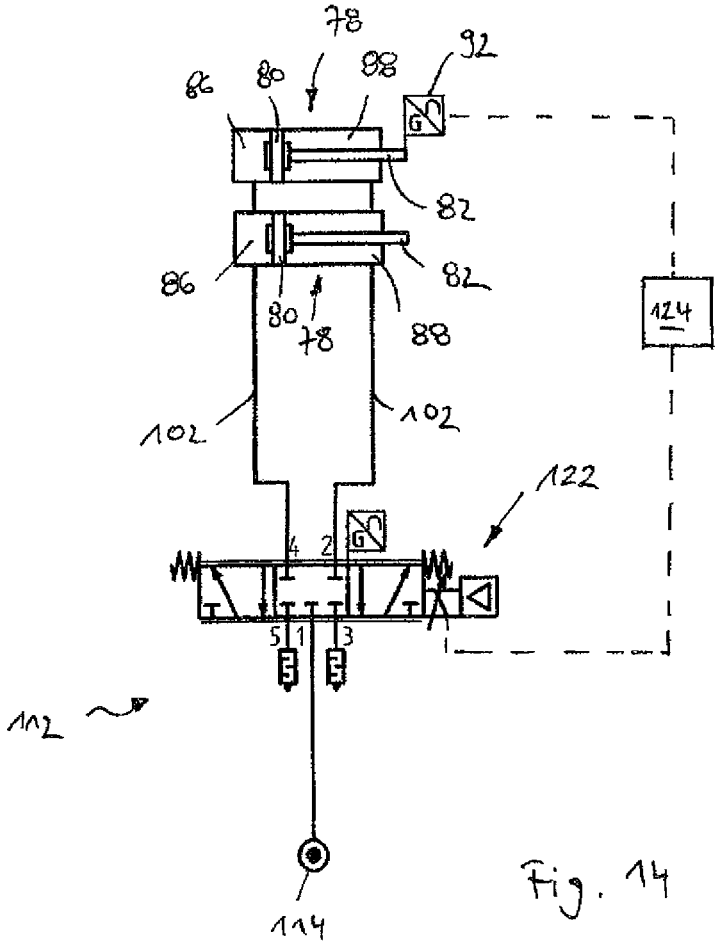
FIG. 14 a schematic view of an additional embodiment of a supply device.

In the embodiments of supply devices 112 illustrated in FIGS. 13 and 14, a pressure supply 114 communicates with the various interior spaces 86, 88 of the units 78 via a 4/3-way valve 122. In the switch position illustrated in FIG. 13, the operation of the force application device 76 corresponds to the operation of the force application device 76 described above with reference to FIGS. 3 to 6. In the other two switch positions of the 4/3-way valve 122, the pressure supply 114 can be selectively connected for fluid conduction either with the first interior spaces 86 of the units 76 or with the second interior spaces 88 of the units 78, so that the deceleration and/or acceleration forces that can be produced with the force application device 76 can be intentionally changed.

In an advantageous further embodiment according to FIG. 14, a control device 124 is provided which is coupled with the device 92 for measuring the position of the bearing member 52 relative to the swivel member 44 and which controls the 4/3-way valve 122 depending on the position of the bearing member 52.

For example, the force profiles illustrated in FIGS. 15 to 18 can be generated with such control. For example, by switching the valve 122, the pressure supply 114 is connected with the second interior spaces 88 at a workpiece position "90°" and with the first interior spaces 86 at a workpiece position "270°".

Figure 15:
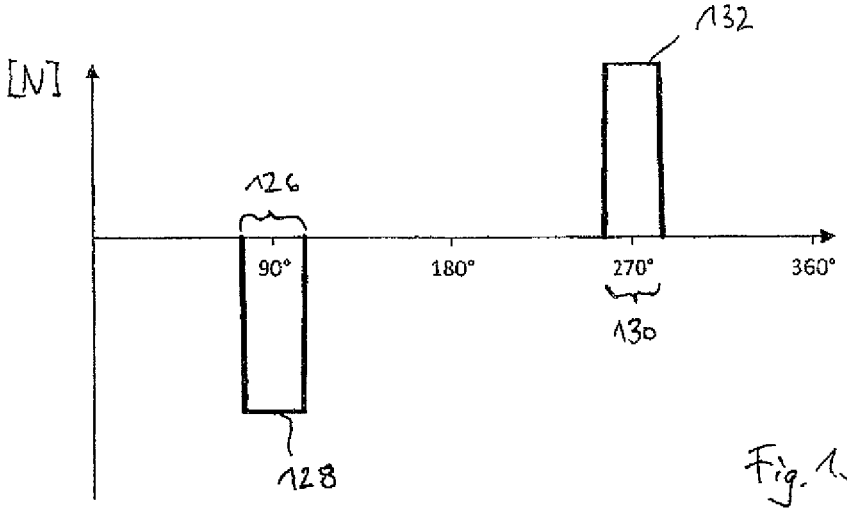
FIGS. 15 to 18 schematic diagrams with examples of a dependence of deceleration and/or acceleration forces as a function of the rotation position of the workpiece.

When using a simple switching valve for the valve 122, the force profiles illustrated, for example, in FIG. 15 can be produced. For example, connecting the pressure supply 114 with the second interior spaces 88 for a time duration 126 creates a force profile segment 128, corresponding to an acceleration force directed toward the left side along the guide axis 54 of the linear guide 50. Likewise, connecting the pressure supply 114 with the first interior spaces 86 for a time duration 130 creates a force profile segment 132, corresponding to an acceleration force directed toward the right side along the guide axis 54 of the linear guide 50.

Figure 16:
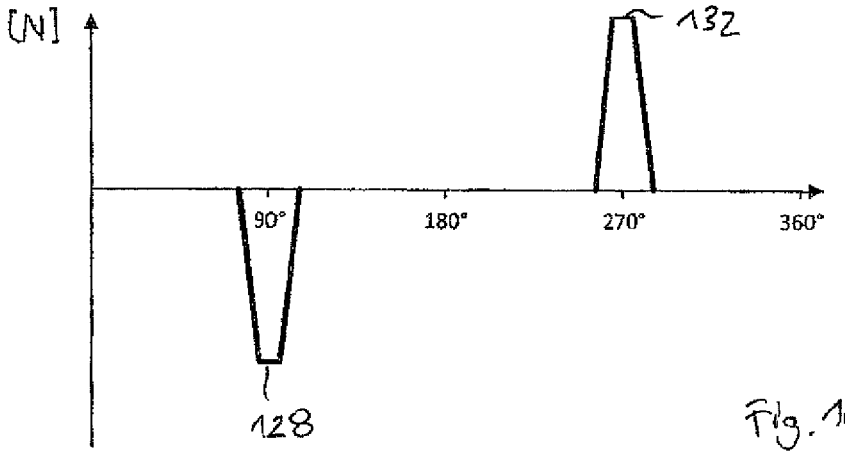
Figure 17:
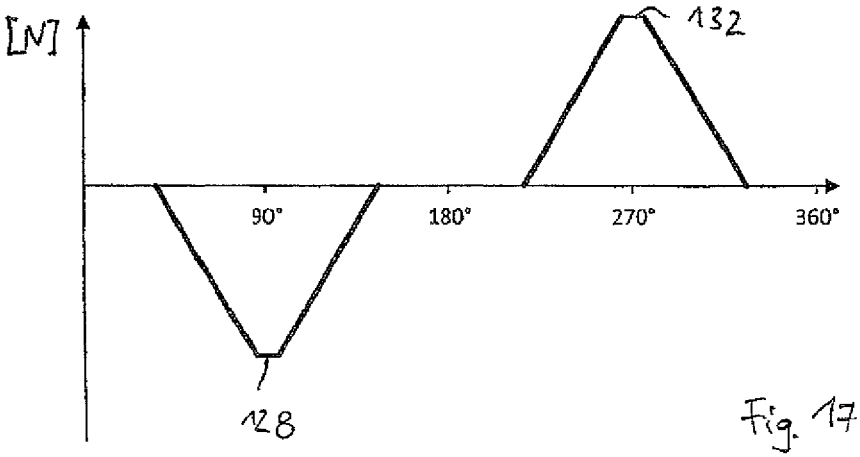
Figure 18:
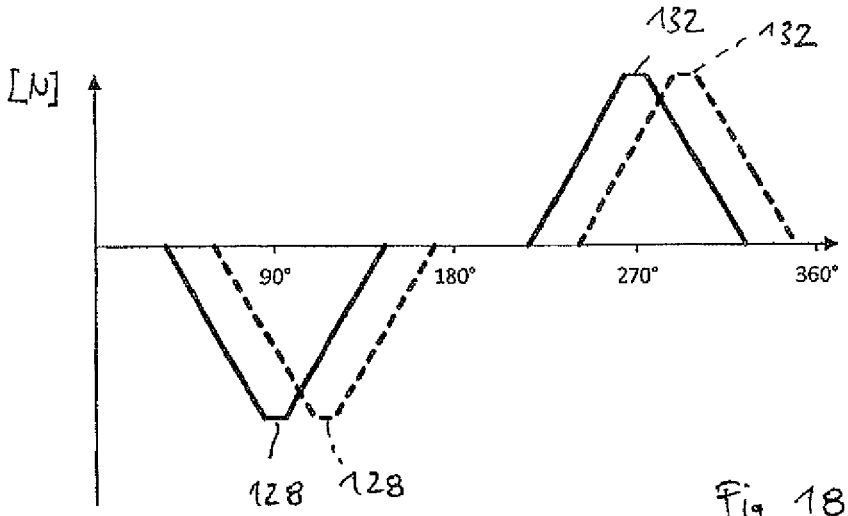

When using a proportional valve for the valve 122, the force profiles illustrated in FIGS. 16 to 18 having a steeper increase to a force maximum (FIG. 16) or a shallower increase to a force maximum (FIG. 17) are feasible. It will be understood that the force maxima need not necessarily be applied in the region of the workpiece positions "90°" and "270°", i.e. at the reversal positions of the bearing member 52. The applied forces can also be offset by an angle relative to these positions, see FIG. 18.

Figure 19:
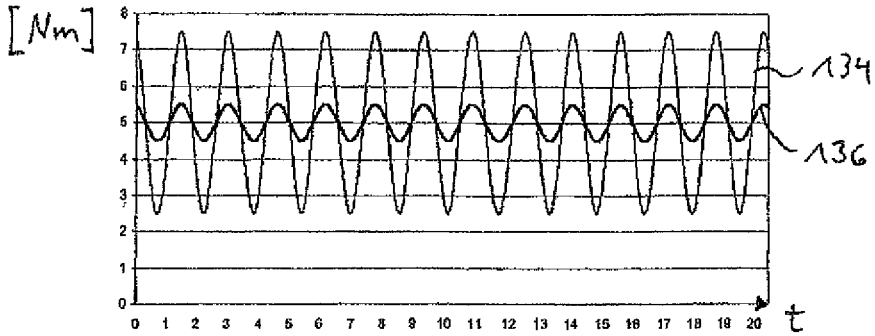
FIG. 19 a schematic diagram of the course of the drive torque applied to a rotary drive device of the device without and with the use of a force application device.

With the device according to the invention, a more uniform drive torque can be supplied by the rotary drive device 24 for rotatably driving the workpiece 12. FIG. 19 shows the time-dependent curves of drive torques of the rotary drive device 24. These curves vary sinusoidally between maximum and minimum values. A complete sinusoidal oscillation hereby corresponds to a single revolution of a workpiece 12 about its workpiece axis 26. Without the use of a force application device 76, a drive torque curve 134 varies much stronger than in an embodiment where a force application device 76 is employed, with which a markedly more uniform, ideally even almost constant drive torque curve 136 is attained.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A device for fine-machining a peripheral workpiece surface which is eccentrically arranged in relation to a workpiece axis of a workpiece, comprising:

a rotary drive device for rotatably driving the workpiece about the workpiece axis, a pressing device for pressing a fine-machining tool against the peripheral workpiece surface, a bearing device for supporting the pressing device on a frame and having a bearing member, and a force application device applying at least one of a deceleration force or an acceleration force on the bearing member, which moves back and forth between two reversal positions due to a rotation of the workpiece.

2. The device of claim 1, wherein the peripheral workpiece surface is a pin bearing of a crankshaft.

3. The device of claim 1, wherein the force application device applies at least in one of the two reversal positions to the bearing member an acceleration force that is directed towards the other of the two reversal positions.

4. The device of claim 1, wherein the force application device applies at least in both respective reversal positions of the bearing member on the bearing member an acceleration force that is directed towards the respective other reversal position.

5. The device of claim 1, wherein the force application device applies to the bearing member a deceleration force or an acceleration force, when the bearing member is located at an intermediate position between the reversal positions.

6. The device of claim 1, wherein the force application device comprises an energy store which is charged during a movement of the bearing member from a first reversal position to a second reversal position and which is discharged during a movement of the bearing member from the first reversal position to the second reversal position.

7. The device of claim 6, wherein the energy store comprises mechanical or pneumatic spring elements.

8. The device of claim 1, wherein the force application device comprises at least one cylinder/piston unit.

9. The device of claim 8, comprising an additional volume, wherein the additional volume in fluid communication with an interior space of a cylinder of the cylinder/piston unit.

10. The device of claim 9, comprising a supply device for applying a presettable fluid pressure to the interior space of the cylinder or to the additional volume connected with the interior space.

11. The device of claim 10, wherein the fluid pressure is changeable.

12. The device of claim 1, comprising a control device for controlling at least one property of the deceleration and acceleration forces acting on the bearing member, said property selected from a magnitude, a direction and a time dependence of the deceleration and acceleration forces.

13. The device of claim 1, comprising a device for measuring a position of the bearing member.

14. The device of claim 1, comprising a linear guide guiding the bearing member.

15. The device of claim 14, comprising a swivel member pivotally supporting the linear guide relative to the frame.

16. The device of claim 15, comprising a carriage which is movably supported on the frame and which supports the linear guide for movement in a direction transversely to a guide axis of the linear guide.

17. The device of claim 16, wherein the carriage supports the linear guide for movement in a direction perpendicular to a guide axis of the linear guide.

18. The device of claim 16, comprising an additional force application device for compensating mass-induced inertial forces which are generated by a movement of the bearing member about a swivel axis or by movement of the bearing member in the direction transversely to the guide axis of the linear guide.

19. The device of claim 1, wherein the bearing member is movable between the reversal positions along a vertical axis defined in relation to a direction of gravitational forces, the device further comprising a compensation device which generates at least proportionately a vertically upwardly directed holding force of identical magnitude as a force produced by a weight of the pressing device, by a weight of the bearing member and by a weight of the fine-machining tool.

20. The device of claim 1, wherein the bearing member is movable between the reversal positions along a vertical axis defined in relation to a direction of gravitational forces, wherein the force application device generates at least proportionately a vertically upwardly directed holding force of identical magnitude as a force produced by a weight of the pressing device, by a weight of the bearing member and by a weight of the fine-machining tool.

21. The device of claim 1, wherein the fine-machining tool is a finishing tool for finish-machining of the peripheral workpiece surface.

22. The device of claim 1, further comprising an oscillatory drive for applying to the workpiece an oscillatory motion that is parallel to the workpiece axis.

* * * * *